US006145682A

United States Patent [19]

Speck et al.

[11] Patent Number: 6,145,682

[45] Date of Patent: Nov. 14, 2000

[54] MODIFYING STRUCTURES FOR A FOLDABLE STORAGE CRATE, AND METHOD OF USING SAME

[75] Inventors: John W. Speck, Farmington Hills; Ted Kropiewnicki, Garden City, both of Mich.

[73] Assignee: Tri-Tech Engineering Group, Livonia, Mich.

[21] Appl. No.: 09/384,684

[22] Filed: Aug. 27, 1999

[51] Int. Cl.[7] ..... B65D 88/00

[52] U.S. Cl. ..... 220/1.5; 220/6; 220/23.4; 206/600

[58] Field of Search ..... 220/1.5, 6, 23.4, 220/23.83, 23.86; 206/600; 160/332

[56] References Cited

U.S. PATENT DOCUMENTS

| | | | |
|---|---|---|---|
| 3,371,815 | 3/1968 | Macomber | 220/1.5 |
| 3,599,824 | 8/1971 | Pneuman . | |
| 4,498,584 | 2/1985 | Newbury | 206/510 |
| 4,784,510 | 11/1988 | Messori . | |
| 4,917,255 | 4/1990 | Foy et al. | 220/6 |
| 4,942,975 | 7/1990 | Capron et al. . | |
| 5,135,247 | 8/1992 | Alfaro et al. . | |
| 5,199,589 | 4/1993 | Noble | 220/7 |
| 5,433,550 | 7/1995 | Huber . | |
| 5,449,081 | 9/1995 | Sjostedt et al. . | |
| 5,454,673 | 10/1995 | DiMartino . | |

*Primary Examiner*—Stephen Castellano

*Attorney, Agent, or Firm*—Carrier, Blackman & Associates, P.C.; Joseph P. Carrier; William D. Blackman

[57] ABSTRACT

An open frame structure for attaching to a storage crate in place of an end wall thereof including a base member, two side bars, and a restraining member. The two side bars are attached to opposite ends of the base member and disposed substantially transverse thereto. The first and second side bars of the frame member define a substantially open access port therebetween. The restraining member connects the side bars and includes a central connector to allow separation thereof into two segments. The open frame structure may optionally also include a hinge means. The hinge means includes a plurality of flanges affixed to the base member and extending downwardly therefrom. Each of the flanges has a hole formed therethrough for receiving a hinge pin therethrough. The hinge means may alternatively include a cross plate attached to the storage crate, and a hinge pivotally attached to the cross plate and the base member. Additionally, if a larger size crate is desired, the invention provides a reinforced storage crate assembly formed by connecting end-to-end two or more storage crates including a first storage crate, a second storage crate, a binding means, and at least one stiffening member. The storage crates each have an open end formed by removal of an end wall, and are attached at the open ends by a binding means. Each stiffening member reinforces a corresponding side wall of the storage crate assembly. Each stiffening member and attaching hardware are sufficiently recessed into a corresponding storage crate side wall to allow the storage crate assembly to be collapsibly folded without interference between any of the side walls, stiffening members, or hardware.

14 Claims, 6 Drawing Sheets

PRIOR
ART

FIG 2
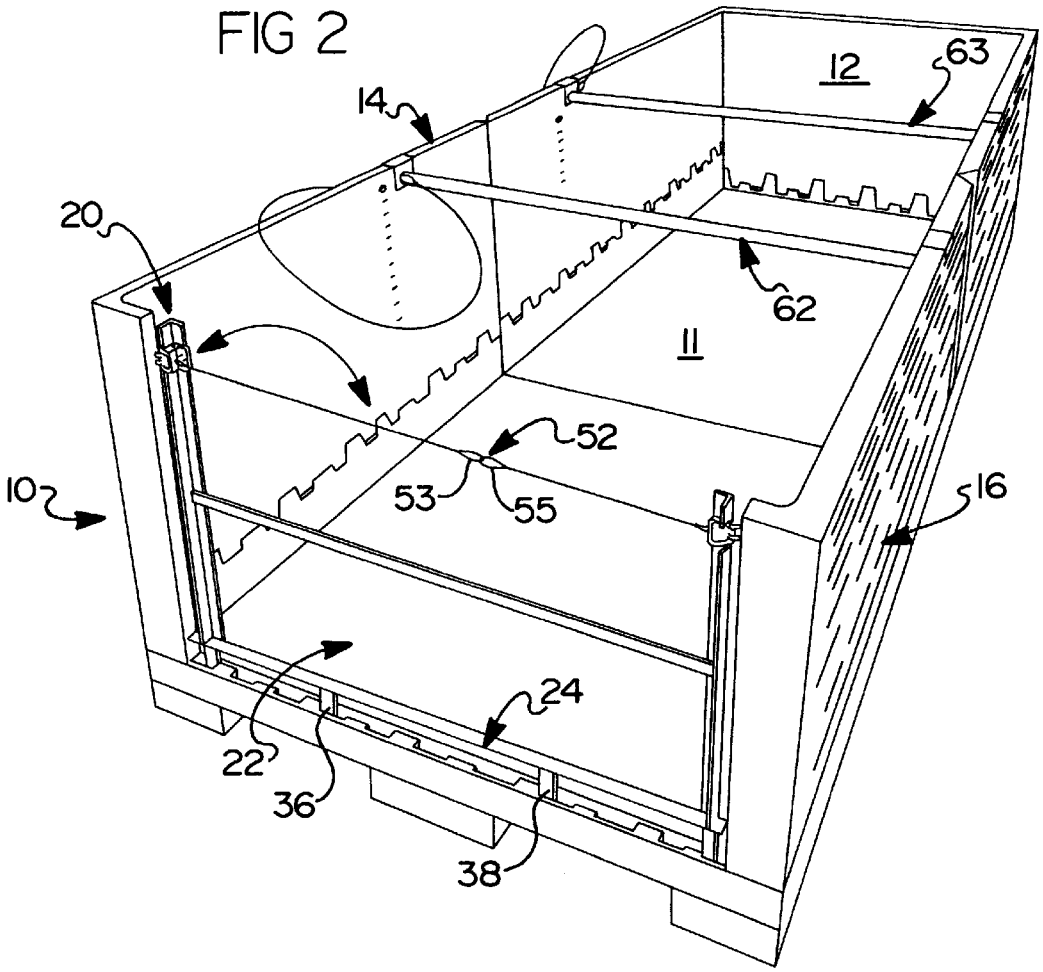
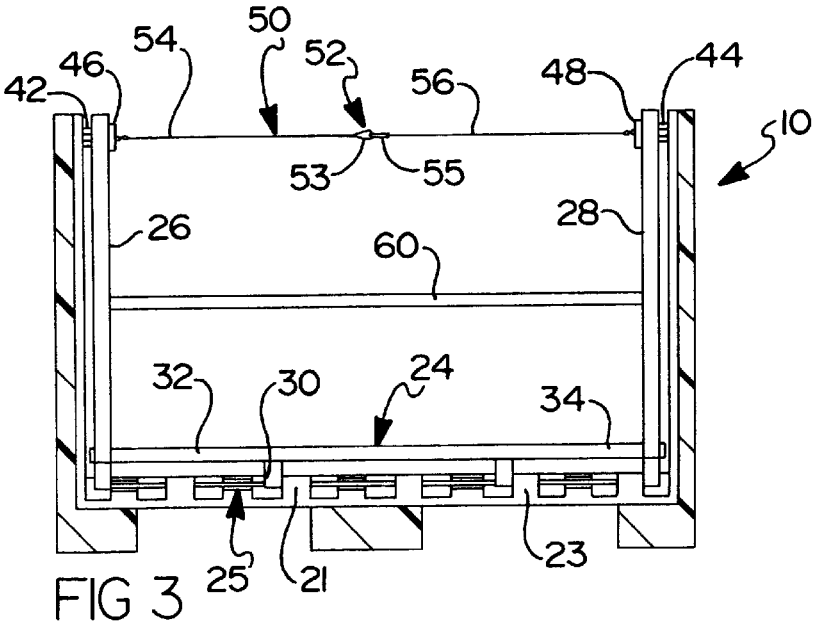
FIG 3
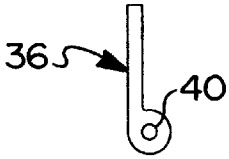
FIG 4

FIG 5A
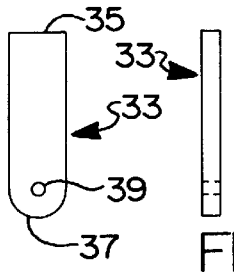
FIG 5B
FIG 6
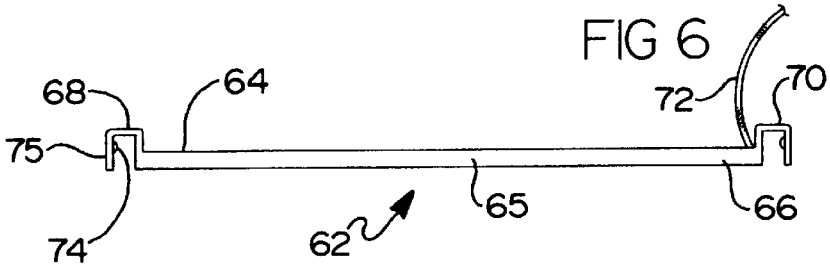
FIG 7
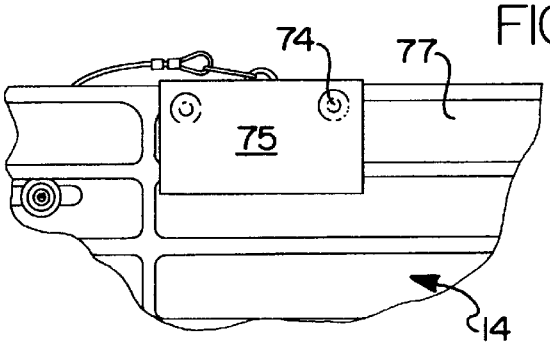
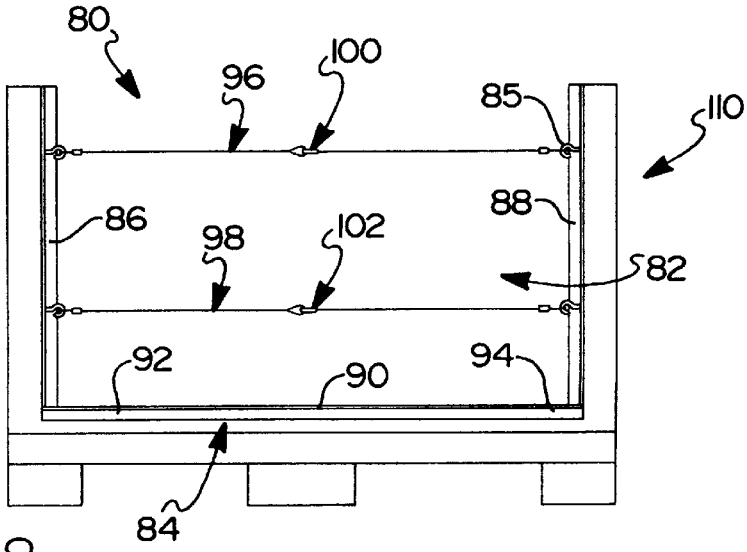
FIG 8

FIG 10
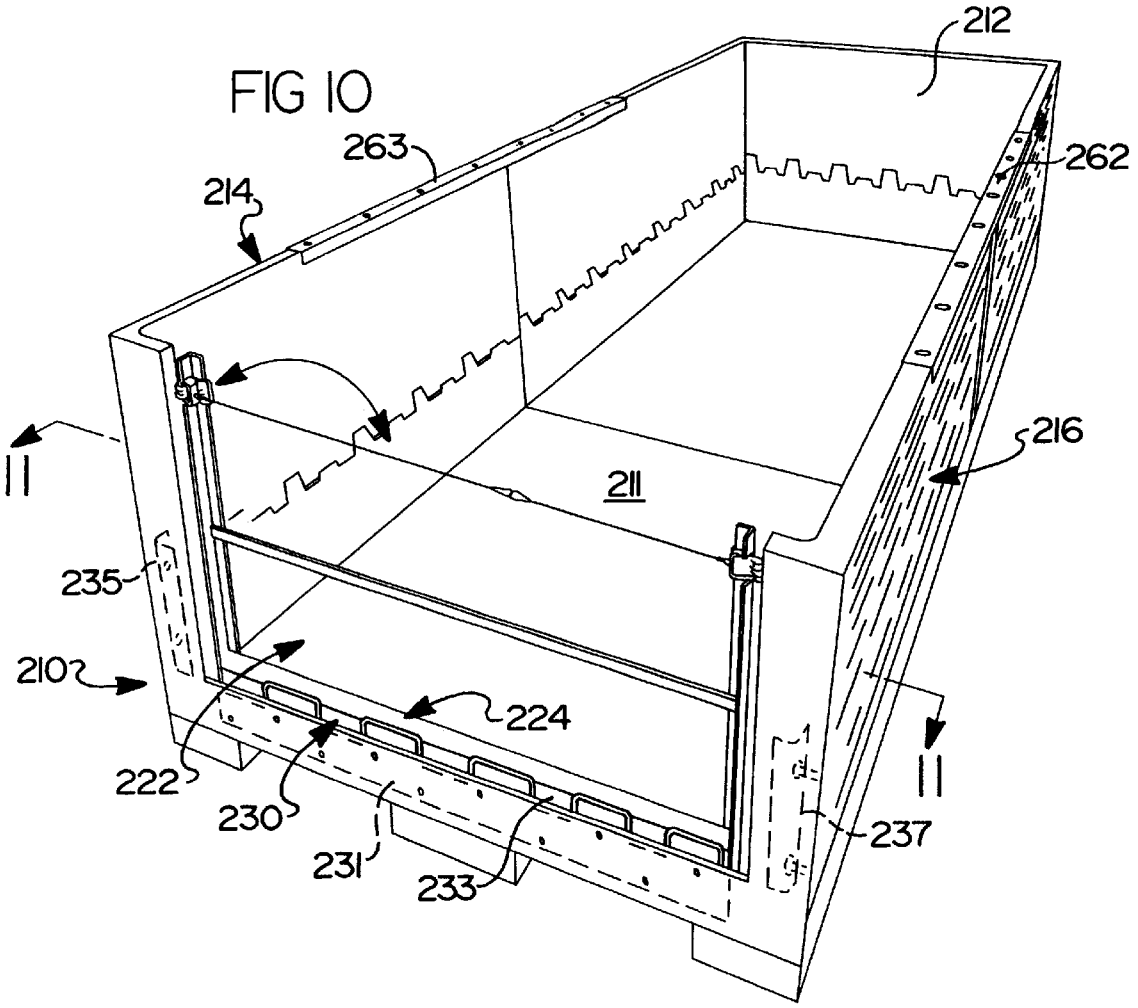
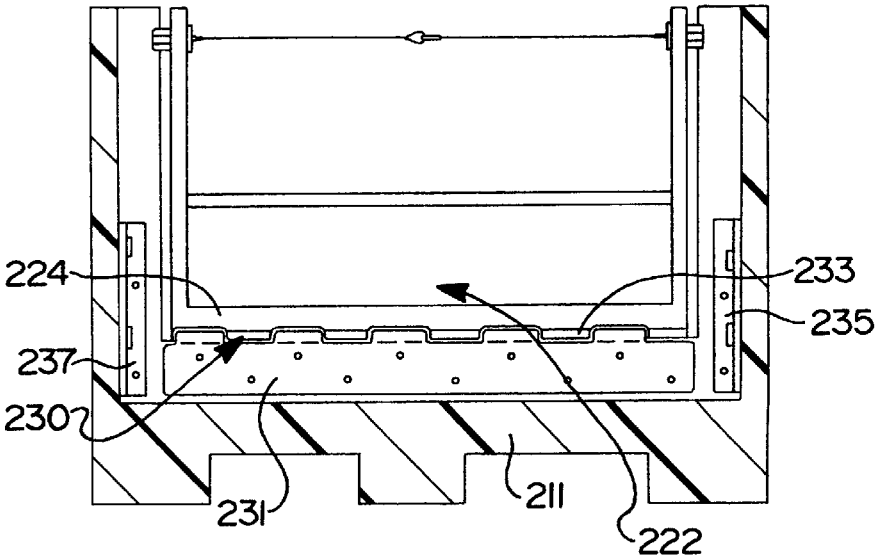
FIG 11

FIG 12
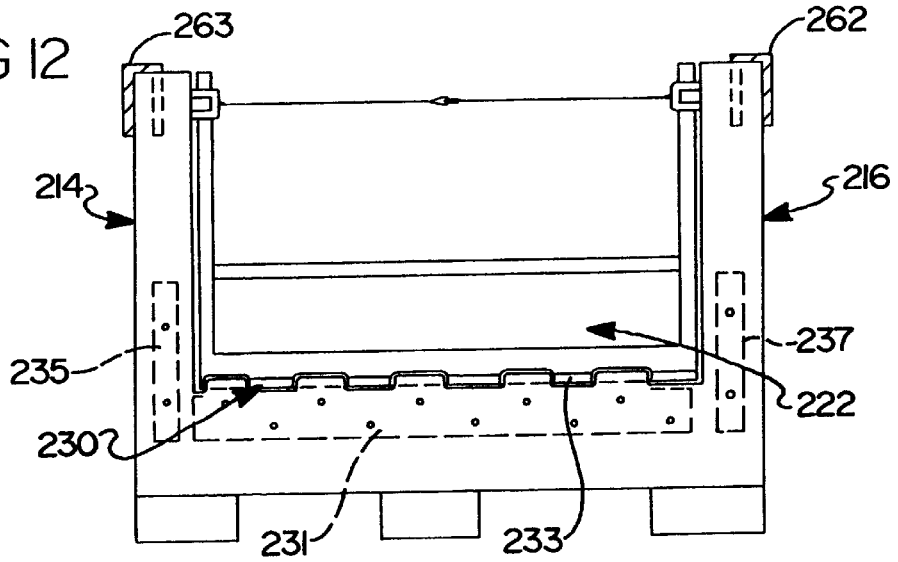
FIG 13A
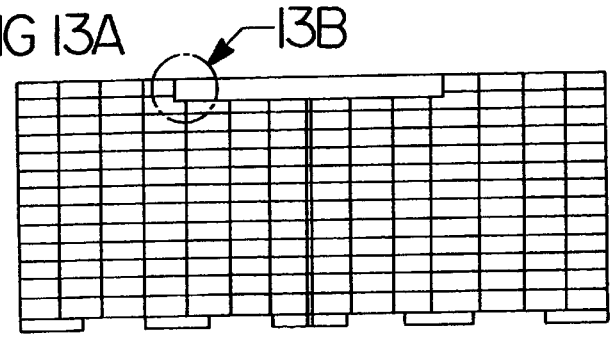
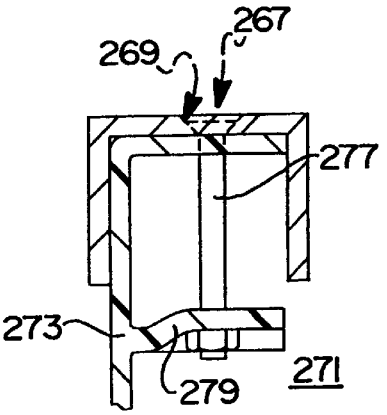
FIG 14
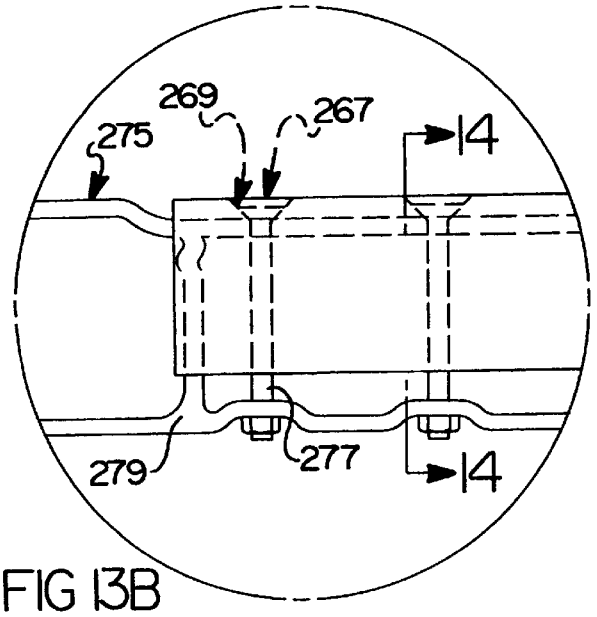
FIG 13B

MODIFYING STRUCTURES FOR A FOLDABLE STORAGE CRATE, AND METHOD OF USING SAME

BACKGROUND OF THE INVENTION

1. Field of the Invention

The present invention relates to storage crates, and to modifying structures therefor. More particularly, the present invention relates to an open end frame structure for replacing at least a portion of an end wall of a storage crate, and to stiffening members for reinforcing the side walls of a large storage crate formed by combining smaller storage crates.

2. Background Art

Storage crates are widely used in industrial settings. In particular, large industrial storage crates are commonly used in shipping and in warehousing inventory. A commonly used type of large plastic storage crate, which is foldably collapsible when not in use, is commercially available from the Ropak Corporation of Georgetown, Ky., and is described in U.S. Pat. No. 4,923,079, the disclosure of which is hereby incorporated by reference. The collapsible nature of the crates is very desirable for reducing the space required to store and transport the crates when empty.

Many other types of storage crates are commercially available. Sometimes storage crates, for use in a particular application, are found to be more convenient to use if they are modified to have a substantially open end wall, in order to make an interior end portion thereof more accessible, to more easily remove individual parts therefrom, as needed.

Referring now to FIG. 1, the applicant has previously proposed to modify a foldable plastic storage crate 9, relative to an open end thereof, in the following manner. First, a fully formed foldable storage crate is obtained, and then, a saber saw or other portable power saw is used to cut away the majority of an end panel thereof, leaving only a lower hinge section 13 of the end panel intact. The entire top section (not shown) of the end panel, approximately 80–90% of the panel, is cut off, leaving the lower section 13, which includes a plurality of interlocking hinge extensions 15, in place. The hinge extensions 15 receive a hinge pin 17 therethrough, to cooperate with corresponding hinge extensions extending upwardly from the floor section 19 of the crate 9, in forming a hinge joint. The cut away portion (not shown) is discarded or recycled.

Then, a rigid C-shaped frame 18, which is made of flat metal stock or of angle iron, is attached to the remaining bottom section 13 of the end panel using screws, rivets, or other appropriate fastening means, to create an open-ended crate, with the existing hinge joint from the original end panel still in place and working. Conventional cable material C may be strung across the frame 18 as shown, as a means to restrain objects within the crate from passing through the open frame when not desired. A spring clip or the like is provided on one end of each cable for permitting the cable end to be disengaged from the frame when desired.

Sometimes a particular storage crate does not have adequate capacity for a specific application thereof, and a user may wish to connect two or more storage crates together to form a larger capacity crate assembly. Methods and equipment for connecting containers together are discussed in U.S. patent application Ser. No. 09/066,872 filed Apr. 27, 1998, the disclosure of which is hereby incorporated by reference.

Once connected, the side walls of the larger capacity crate assembly span typically twice the distance of their original side wall design intent. As such, they usually lack sufficient stiffness to resist bowing outward when the container is filled with storage materials. Most conventional methods and equipment for connecting such containers together to form a larger capacity container fail to address this problem.

U.S. patent application Ser. No. 09/066,872 filed Apr. 27, 1998 does address this problem, but such disclosure is difficult in practice to use. The referenced patent application discloses an optional side rail, typically consisting of ¼" steel bar stock for reinforcing the side walls of a larger container assembly. The side rail disclosed therein requires extensive modifications to the container side walls in order to be installed. Such modifications include routering of container side walls to provide slots for such side rails, as well as drilling attachment holes in portions of the side walls which are difficult to access. Installation of such side rails is therefore very cumbersome and undesirable.

While numerous varieties of storage containers are known and available for storing materials of various types, a need still exists for improved modifying structures for storage crates. In particular, there is a need for an improved end member for use in a storage crate, to provide an open-ended storage crate, which still provides strength and support to safely ship inventory therein, when the modified open-ended crate is used in conjunction with an open frame end panel thereacross. In addition, there is a particular need for stiffening members to reinforce the side walls of large capacity storage crates formed from the union of two or more smaller storage crates.

SUMMARY OF THE INVENTION

The present invention provides an open frame structure for use as an end panel of a storage crate. The present invention contemplates open frame structures for use with both collapsibly foldable and with non-collapsible storage crates. The present invention also provides stiffening members for use in reinforcing the side walls of a large storage crate formed by combining two or more smaller storage crates.

An open frame structure according to the invention is provided for attaching to a collapsible storage crate in place of an end wall thereof, and includes a base member, two side bars, at least one restraining member, and a hinge means. The first and second side bars of the frame member define a substantially open access port therebetween.

The hinge means preferably includes a plurality of flanges affixed to the base member and extending downwardly therefrom. The first and second side bars are attached to opposite ends of the base member and are disposed substantially transverse thereto. Where flanges are provided as part of the hinge means, each of the flanges has a hole formed therein for receiving a hinge pin therethrough.

Alternatively, the hinge means may include a cross plate mountable to the storage crate, and a hinge connecting the cross plate to the lower portion of the base member.

The frame member includes at least one restraining member for joining the first and second side bars. The restraining member is preferred to include a disengagable central connector for separating the restraining member into first and second segments.

In another aspect of the invention, an open frame structure according to the invention is provided for fixedly attaching to a storage crate in place of an end wall thereof. This aspect includes a base member, two side bars, at least one restraining member, and fastening means for fixing frame members to the walls of the storage crate. The first and second side bars of the frame member of this aspect also define a substantially open access port therebetween, but the base member and two side bars are fixedly attached to the storage crate by the fastening means.

In a different aspect of the invention, stiffening members may be used alone or in conjunction with the open frame structures. Each stiffening member, which is preferably substantially U-shaped in cross section, reinforces a side wall formed from interconnected storage crates by securely receiving an upper edge portion of the side wall into the U-shaped channel. The engaged stiffening member is preferably fastened to the side wall such that the stiffening member compresses the upper edge portion of the side wall contained therein, such that the upper surface of the stiffening member is substantially flush with the upper surface of the remainder of the side wall not contained in the stiffening member.

It is an object of the present invention to provide an open end frame structure for replacing at least a portion of an end wall of a collapsible storage crate, which includes at least one restraining member for retaining stored items within the storage crate, which restraining member is easily separated into two segments, for providing easy access to the storage compartment.

Another object of the present invention is to provide an open frame structure for simply replacing an end wall of a collapsible storage crate, or a portion of the end wall, which open frame structure is pivotable between a vertical upright position, and a horizontal, collapsed position adjacent to the floor of the storage crate.

It is a further object of the invention to provide a storage crate assembly formed from the union of two smaller storage crates, which assembly has reinforced side walls.

For a more complete understanding of the present invention, the reader is referred to the following detailed description section, which should be read in accordance with the accompanying drawings. Throughout the following description, like numbers refer to like parts.

BRIEF DESCRIPTION OF THE DRAWINGS

FIG. 2 is a perspective view of a large collapsibly foldable storage crate assembly, created from the union of two smaller storage crates, having an open frame structure according to the first preferred embodiment of the present invention installed in an end thereof, the crate further having two optional brace members installed across the tops of the side walls thereof;

FIG. 3 is an end elevational view of the crate and frame structure of FIG. 2, taken from a vantage point inside the crate looking out, with parts of the crate shown in cross section;

FIG. 4 is a side plan view of a first embodiment of a flange which may form a part of the open frame member of FIGS. 2–3;

FIG. 5A is a side plan view of a second, alternative embodiment of a flange which may form a part of the open frame member of FIGS. 2–3;

FIG. 5B is a front plan view of the flange of FIG. 5A;

FIG. 6 is a front elevational view of an optional brace member;

FIG. 7 is a detail side elevational view, partially broken away, of the crate of FIGS. 2–3, also showing the exterior of an engagement member which is a part of the brace member of FIG. 6;

FIG. 8 is an end elevational view of a storage crate incorporating an open frame structure according to a second preferred embodiment of the invention, taken from a vantage point outside of the crate.

FIG. 10 is a perspective view of a foldable storage crate, having an open frame structure according to a third preferred embodiment of the present invention installed in an end thereof, the crate further having two brace members according to another aspect of the invention installed along the upper portion of the side walls thereof;

FIG. 11 is an end elevational view of the crate and frame structure of FIG. 10, taken from a vantage point inside the crate looking out, with parts of the crate shown in cross section;

FIG. 12 is an end elevational view of the crate and frame structure of FIG. 10, taken from a vantage point outside of the crate;

FIG. 13 is a detailed side plan view of a portion of the side wall of the crate of FIG. 10, and a portion of the reinforcing member attached thereto;

FIG. 14 is a detailed cut away plan view of the portion of the side wall and reinforcing member attached thereto of FIG. 13.

DETAILED DESCRIPTION OF THE PRESENTLY PREFERRED EMBODIMENTS

Figure 1:
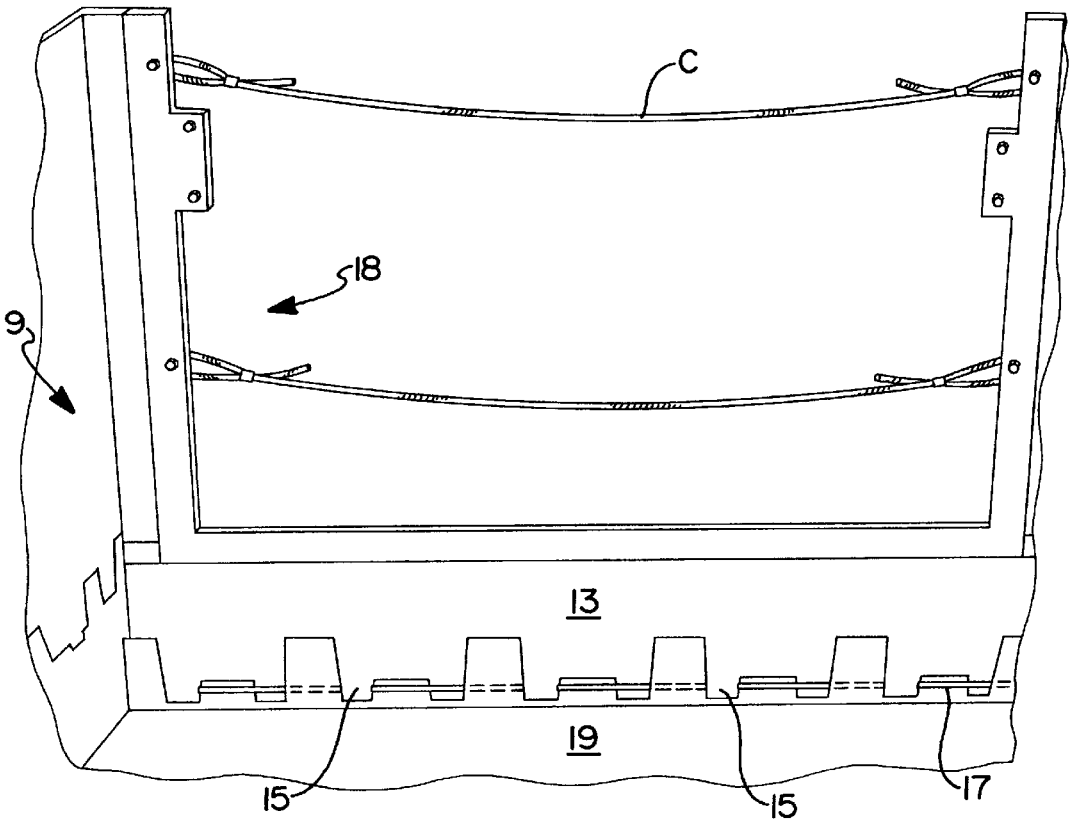
FIG. 1 is a perspective view of a collapsibly foldable storage crate as previously proposed by the applicant, wherein the crate has been modified according to the previously known method of modifying such crates to include an open frame member on an end wall thereof, seen from a vantage point inside the crate looking toward an end wall thereof.

Referring now to FIGS. 2–3 of the drawings, a collapsible storage crate, in accordance with the first preferred embodiment of the invention, is shown generally at 10. The crate 10 in the depicted embodiment is a modified and improved version of a collapsible plastic storage crate originally sold by the ROPAK corporation, and is made up of two storage crates joined end-to-end with the intermediate walls thereof removed, for larger capacity crate. The crate 10 includes a floor 11, an end wall 12 pivotally attached to the floor and having a first hinge pivot pin thereof disposed at a first height above the floor. The crate further includes a first side wall 14 pivotally attached to the floor and having a hinge pivot pin thereof disposed at a second height above the floor which is above the height of the first hinge pivot pin to allow the side wall 14 to fold down on top of an already collapsed end wall 12. The crate 10 further includes a second side wall 16 pivotally attached to the floor opposite the first side wall the second side wall being joined to the floor by a third hinge pivot pin which is disposed at substantially the same height as the second pivot pin. The crate 10 also includes an open frame structure 20, in accordance with a first embodiment of the invention, pivotally attached to the floor 11 opposite the end wall 12. The open frame structure 20 generally forms a frame surrounding and defining a substantially open access port 22 centrally therein, to allow access by a user to the interior of the crate 10.

In the embodiment of FIGS. 1–2, the frame structure 20 is pivotally foldable into the crate 10, as shown by the two-headed arrow in FIG. 1, to lie flush against the floor 11 when in a closed configuration thereof.

The open frame structure 20, according to the invention, is provided for attaching to a storage crate in place of an end wall thereof, and includes a base member 24, two side bars 26, 28, and a hinge means, 30. The first and second side bars 26, 28 of the frame structure 20 define the substantially open access port 22 therebetween. The respective side bars 26, 28 are attached to the respective first and second ends 32, 34 of the base member 24, and are disposed substantially transverse thereto.

The frame structure 20 is preferably made of metal, and most preferably of iron or steel. Alternatively, the frame structure 20 could be made out of a strong plastic material. Each of the base member 24 and the two side bars 26, 28 may be formed using angle iron, oriented so that a flat face thereof is facing toward the inside of the crate 10.

Also in the preferred frame structure 20 of the invention, the hinge means 30 includes a plurality of flanges, such as those shown at 36 and 38, affixed to the base member 24 and extending downwardly therefrom. As shown by the representative flange 36 in FIG. 4, each of the flanges has a hole 40 formed therethrough to receive a hinge pin 25 (FIG. 2). The hole 40 through the flange 36 is substantially parallel to the longitudinal axis of the base member 24. The material making up each of the flanges 36, 38 is preferred to completely surround the hole 40 formed therein.

An alternative design of a flange 33, which is usable with the frame structure 20 of the present invention, is illustrated in FIGS. 5A–5B. This flange 33 is formed from a relatively thin sheet of material, such as, for example, quarter inch or ⅜" bar stock, with a flat upper edge surface 35 and a rounded lower surface 37 to allow pivotal turning of the frame structure 20 about the hinge pin 25. The flange 33 has a hole 39 formed therethrough to receive the hinge pin 25, and the material of the flange completely surrounds the hole 39 to provide strength to the flange.

Preferably, each of the side bars 26, 28 has an integral latch support bracket 46, 48 respectively thereon. The frame structure 20 hereof may also include first and second latch members 42, 44 attached to the respective first and second side bars 26, 28, proximate the upper ends thereof. The latch members 42, 44 are preferably mounted on the latch support brackets 46, 48, and include slidable latching teeth which securely engage latching openings formed in the to facing surfaces of the side walls 14, 16, and also include biasing means such as a spring to normally urge the latching teeth toward a latched position thereof.

The frame structure 20 also includes at least one restraining member 50 for connecting between the side bars 26, 28, which restraining member preferably includes a cable, but may formed from a fabric strap, metal bar, or other suitable material. The restraining member 50 functions as a means for selectively retaining objects in the storage crate, and as a cable is preferred to be of a multi-filament metal wire. Preferably, the restraining member 50 is attached to the frame structure 20 between the two latch support brackets 46, 48. In the most preferred embodiment of the invention, each support restraining member 50 includes a disengagable central connection 52, to allow separation of the restraining member into first and second sections 54, 56 thereof. The disengagable central connection may be made up of a spring-loaded clip 53 and a ring 55 for connecting the clip on to.

The frame structure 20 is also preferred to include a solid second restraining member 60 for rigidly joining the first and second side bars 26, 28, and for providing added strength and support to the structure 20. The second restraining member 60 is preferred to be made of a flat strip of the same material as the base member 24 and the side bars 26, 28.

This first preferred embodiment may optionally include brace members 62, 63, to reinforce the side walls of the storage crate. A brace member, such as the exemplary brace member 62 shown in FIG. 5, includes a reinforcing rod 65 having opposed first and second ends 64, 66. The reinforcing rod may be a hollow tubular member, such as a steel tube. The brace member 62 also includes first and second substantially C-shaped engaging members 68, 70, attached to the respective first and second ends 64, 66 of the reinforcing rod 65. The engaging members 68, 70 are provided for sliding placement on the top edges of opposed first and second side walls 14, 16 of a storage crate 10. Preferably, the brace member 62 also has a flexible cable 72 attached to an outer end 66 of the reinforcing rod 65, or to one of the engaging members 68 or 70. Where used, the flexible cable 72 is connectable to a side wall 14 of a storage crate 10.

Preferably, each of the engaging members 68, 70 of the brace member 62 has at least one dimple 74 formed in an outer wall 75 thereof (FIGS. 6–7), to engage in a recess 77 of a crate side wall 14.

Referring now to FIG. 8, a second preferred embodiment of the invention comprises a non-pivoting, open frame structure 80 for use in a non-foldable storage crate 110.

The open frame structure 80, according to the invention, is provided for attaching to a storage crate 110 in place of an end wall thereof, and includes a base member 84 and two side bars 86, 88. The first and second side bars 86, 88 of the frame structure 80 define a substantially open access port 82 therebetween. The frame structure 80 may be attached to the crate 110 using screws, rivets, or other appropriate fastening means through members 84, 86, 88 into storage crate walls.

The respective side bars 86, 88 are attached to the respective first and second ends 92, 94 of the base member 84, and is disposed substantially transverse thereto.

The frame structure 80 is preferably made of metal, and most preferably of iron or steel. Each of the base member 84 and the two side bars 86, 88 may be formed using angle iron. Alternatively, a strong plastic could be used.

In this embodiment of the frame structure 80, two cables 96, 98 are attached between and joining the side bars 86, 88. The cable ends may be attached to appropriate eye bolts 85. These cables 96, 98 are each substantially identical to the restraining member 50 as described herein in connection with the first embodiment of the frame structure 20, and preferably include respective central connections 100, 102, to allow separation thereof at the discretion of a user.

Figure 9:
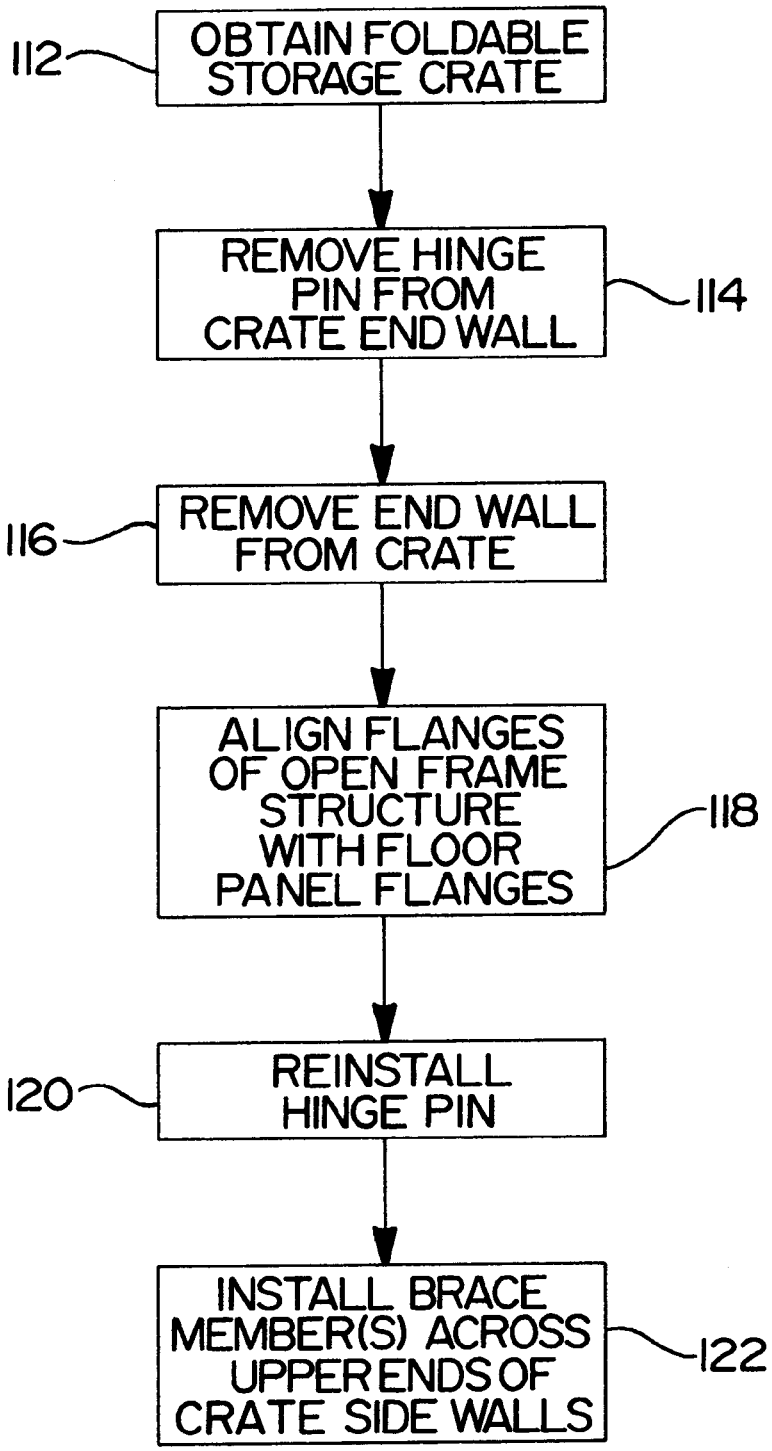
FIG. 9 is a flow chart illustrating steps of a method of modifying a foldable storage crate according to the present invention.

The present invention also contemplates a method of modifying a collapsible storage crate 10 having a floor panel 11 and an end wall (not shown) connected to the floor by a hinge pin 25. Referring now to FIG. 9, a method according to the invention includes a first step 112 of obtaining a foldable storage crate 10. The method then consists of removing the end wall hinge pin 25 in step 114, and then removing the end wall of a storage crate in step 116. The method hereof then involves installing a pivotally foldable open end frame structure 20 on the crate 10, by first, aligning flange members 36, 38 of the open frame structure 20 with corresponding flange members 21, 23 (FIG. 3) of the floor panel 11 in step 118. Then, the hinge pin 25 is slidably inserted into engagement with the flanges 21, 23 of the floor panel 11 and with the intermeshing flanges 36, 38 of the open end frame structure in step 120.

Then, in an optional final step 122, one or more brace members 62, 63, as previously described, is/are placed across the top of the storage crate 10 to interconnect opposed side walls 14, 16 thereof, with the dimples 74 in the brace member outer wall 75 engaging in recesses, such as that shown at 77, in the side walls 14, 16. Preferably, each brace used is attached to a side wall using an anchor cable 72.

Referring now to FIGS. 10–14 of the drawings, a reinforced storage crate assembly formed by connecting end-to-end two or more storage crates, in accordance with the third preferred embodiment of the invention, is shown generally at 210. The third preferred embodiment differs from the first preferred embodiment by the exclusion of brace members 62, 63 and the inclusion of stiffening members 262, 263, as well as the specific application for a storage crate assembly, as opposed to modification of a single storage crate.

The third preferred embodiment generally includes a first storage crate with an end wall removed, a second storage crate also with an end wall removed, the two storage crates abutted against one another at the open ends, a binding means as disclosed in the co-pending application U.S. Ser. No. 09/066,872, to attach the base portion of each storage crate to one another, and a stiffening member for interconnecting and reinforcing the side walls of the joined crates. The stiffening members 262, 263 shown generally in FIG. 10, and more specifically in FIGS. 13–14, are preferably substantially U-shaped in cross section. As shown, the third preferred embodiment also incorporates a hinge means 230 which includes a cross plate 231 and a hinge 233, but the hinge means 30 of the first preferred embodiment may also be used. Additionally, the third preferred embodiment shown includes reinforcing braces 235, 237, which are used to reinforce the storage crate 210 at the sides of the open access port 222.

Except for preferences and aspects related to brace members 62, 63 versus stiffening members 262, 263, reinforcing braces, and a storage crate assembly versus a single storage crate, all other preferences and aspects are the same as the first preferred embodiment.

The hinge means shown in FIGS. 10–12 and included with the second preferred embodiment, is designed for use when a hinge feature is desirable on the frame structure, but the end wall 212 of the storage container does not include a hinge, or does not include a hinge which is modifiable for use according to the first preferred embodiment. The cross plate 231 of the hinge means 230 is designed to attach to a lower portion of the crate end wall 212, or the crate floor 211. It is preferably made of stock steel, but may be made from any other material with sufficient strength.

The hinge means 230 further includes a hinge 233 which pivotally connects the cross plate 231 to a lower portion of the base member 224. The hinge as shown is a standard hinge which typically includes a hinge pin placed through a series of hinge cylinders which are alternatively attached to either the cross plate 231 or the base member 224.

The reinforcing braces 235, 237, shown in FIGS. 10–12, which are preferably used to reinforce the storage crate 210 at the sides of the open access port 222, are preferably made of angle iron, which are substantially L-shaped in cross section, and are boltingly attached to the storage crate along the inside corners.

The stiffening members 262, 263 provide the stiffness necessary to resist bowing of the side walls on a storage crate assembly. Once two or more crates are joined to form a large storage crate assembly, the side walls of the larger capacity crate assembly span typically twice the distance or more of their original side wall design intent. As such, they usually lack sufficient stiffness to resist bowing outward when the container is filled with storage materials.

The stiffening members are preferably made of metal, such as ⅜" stock steel plate, and are formed into a U-shaped channel. Each stiffening member includes a plurality of attachment holes 267 through the its top surface, and bolt head recesses 269 formed in the corresponding top surface thereof.

Each stiffening member 262, 263 is designed to compressingly receive the top wall portion 273 of a storage crate side wall. It is desirable to compress the top wall portion 273 across its width such that a force fit is achieved with each stiffening member 262, 263. A force fit provides maximal stiffening of the storage crate wall as well as improved retention of each stiffening member 262, 263.

Additionally, each stiffening member 262, 263 compresses the top wall portion 273 downward such that each stiffening member is recessed flush with the corresponding top surface of the storage crate wall. This is desirable to allow the storage crate to be foldably collapsed without interference between the top surfaces of stiffening members 262, 263 when opposing side walls 214, 216 are folded down in the same horizontal plane. Compression of the top wall portion 273 downward is accomplished through the use of attachment bolts. Attachment bolts 277 are placed through the plurality of bolt holes 267, which are drilled through each stiffening member 262, 263, as well as through holes drilled through horizontal side wall ribs 279 which are externally part of storage container walls 273. Attachment nuts 281 placed over the bolts 277 on the underside of the side wall ribs 279, allow such fastening of each stiffening member 262, 263. Recesses 269 concentrically located about each bolt hole 267, permit the head of each attachment bolt 277 to be recessed flush with or below the top surface of the corresponding stiffening member 262, 263. The bolt heads are recessed to prevent interference between such heads or other attachments to the opposing side wall, when each side wall is folded down adjacent to the storage crate floor 211, when the crate is foldably collapsed.

Although the present invention has been described herein with respect to preferred embodiments thereof, the foregoing description is intended to be illustrative, and not restrictive. Many modifications may be made to the described embodiments without departing from the scope hereof. All such modifications, which fall within the scope of the appended claims, are intended to be within the scope and spirit of the present invention.

What is claimed is:

1. An open frame structure for attaching to a collapsible storage crate in place of at least a portion of an end wall thereof, comprising:

a base member, having first and second ends;

a first side bar attached to the first end of the base member and disposed substantially transverse thereto;

a second side bar attached to the second end of the base member and disposed substantially transverse thereto, wherein said first and second side bars define a substantially open access port therebetween;

a restraining member for restraining objects in the storage crate, said restraining member having a connector to allow the restraining member to be selectively extended between said first and second side bars; and a hinge means for pivotally supporting said base member on a storage crate, wherein said hinge means comprises:

a cross plate mountable to the storage crate; and a hinge connecting said cross plate to a lower portion of said base member.

2. The frame structure of claim 1, wherein said hinge means comprises a plurality of flanges affixed to said base member and extending downwardly therefrom, each of said flanges having a hole formed therethrough, substantially parallel to the longitudinal axis of the base member, for receiving a hinge pin therethrough.

3. The frame structure of claim 2, wherein said plurality of flanges are adapted to mate with a plurality of hinge flanges provided at a bottom portion of an end wall of the storage crate.

4. The frame structure of claim 3, wherein said base member and said side bars are substantially L-shaped in cross section.

5. The frame structure of claim 1, further including a latch means for connecting each said side bar to a corresponding side wall of said storage crate.

6. The frame structure of claim 1, further comprising a second restraining member for joining said first and second side bars, wherein said second restraining member is located intermediate of said base member and the first said restraining member.

7. The frame structure of claim 1, wherein said frame structure is pivotable about said hinge means between a vertical upright position, and a horizontal, collapsed position adjacent to the inside floor of said storage crate.

8. An open frame structure for attaching to a collapsible storage crate in place of at least a portion of an end wall thereof comprising:

a base member, having first and second ends;

a first side bar attached to the first end of the base member and disposed substantially transverse thereto;

a second side bar attached to the second end of the base member and disposed substantially transverse thereto wherein said first and second side bars define a substantially open access port therebetween;

a restraining member for restraining objects in the storage crate said restraining member having a connector to allow the restraining member to be selectively extended between said first and second side bars wherein said connector is centrally located along said restraining member to allow separation thereof into first and second segments, and wherein said centrally located connector comprises a spring-loaded clip provided on an end of one of said segments, and a ring provided on an end of the other of said segments for attaching the clip thereto; and a hinge means for pivotally supporting said base member on a storage crate.

9. A reinforced storage crate assembly formed by connecting end-to-end two or more storage crates comprising:

a first storage crate having an open end formed by removal of an end wall;

a second storage crate having an open end formed by removal of an end wall, said second storage crate open end abutted against said first storage crate open end;

a binding means attached to a base portion of said first storage crate and a base portion of said second storage crate for restraining said storage crates; and a stiffening member attached to abutted side walls of said first and second storage crates for interconnecting said side walls together, the stiffening member being substantially U-shaped in cross section and securely receiving the upper edge portions of said side walls therein.

10. The reinforced storage crate assembly of claim 9, wherein said stiffening member is formed of metal.

11. The reinforced storage crate assembly of claim 9, said stiffening member having a plurality of holes formed therethrough, further comprising a fastening means including a plurality of bolts and nuts, each said hole for receiving one said bolt therethrough, for bolting said stiffening member to corresponding said side wall.

12. The reinforced storage crate assembly of claim 11, wherein the stiffening member vertically compresses portions of said side walls to which it is attached, such that the top surface of said stiffening member is flush with the portion of the top surface of corresponding said side wall not covered by said stiffening member.

13. The reinforced storage crate assembly of claim 11, said stiffening member further having a plurality of recesses formed therein, each recess concentrically located about a corresponding one of said holes, for receiving a bolt head therein.

14. The reinforced storage crate assembly of claim 11, wherein each head of a stiffening member attachment bolt having a height no greater than the depth of corresponding said recess.

* * * * *